US005279001A

United States Patent [19]

Vento

[11] Patent Number: 5,279,001

[45] Date of Patent: Jan. 18, 1994

[54] TOILET SEAT BIDET ASSEMBLY

[76] Inventor: Osvaldo Vento, 7086 SW. 4th St., Miami, Fla. 33144

[21] Appl. No.: 923,535

[22] Filed: Aug. 3, 1992

[51] Int. Cl.[5] ..... A47K 7/08

[52] U.S. Cl. ..... 4/447; 4/448; 4/420.4

[58] Field of Search ..... 4/420.2, 7, 447, 420.4, 4/448, 420.5, 542, 443

[56] References Cited

U.S. PATENT DOCUMENTS 3,879,769 4/1975 Slawinski et al. ..... 4/447

4,581,779 4/1986 Matsui et al. ..... 4/448

*Primary Examiner*—Henry J. Recla

*Assistant Examiner*—Greg Vidovich

*Attorney, Agent, or Firm*—Malloy & Malloy

[57] ABSTRACT

A toilet seat bidet assembly, for use on a toilet bowl, the assembly including a toilet seat, which includes an upper molded seat portion, a flat base portion structured and disposed for supported positioning atop a rim portion of the toilet bowl, and a central opening, pivotally mounted atop the toilet bowl, and having a hollow channel formed between the upper seat portion and base portion of the toilet seat wherein a pair of flow actuated, pop out cleansing spouts are mounted in spaced apart relation from one another. The spouts are caused to protrude through a side of the upper portion of the toilet seat into the center opening in the toilet seat in response to water pressure so as to disperse water for cleansing a user's intimate parts. The spouts retract and remain protectively concealed within the hollow channel when water flow is stopped so as to shield them from potential contamination.

12 Claims, 2 Drawing Sheets

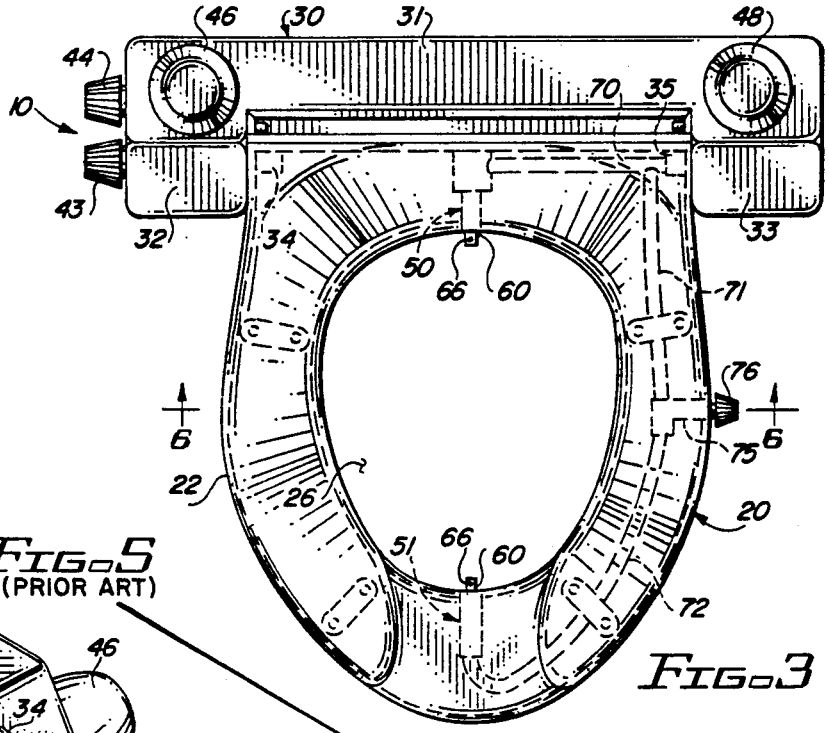
FIG. 3
FIG. 5 (PRIOR ART)
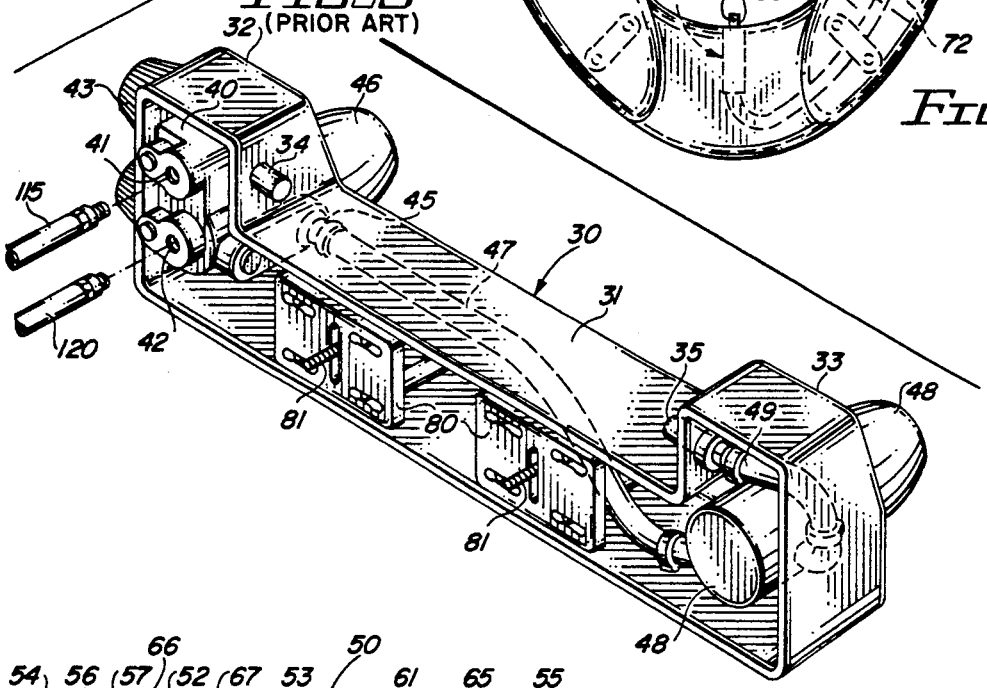
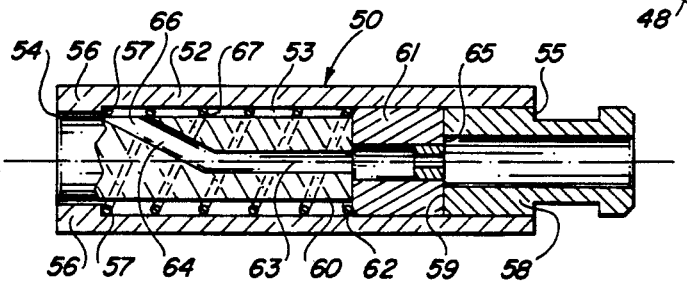
FIG. 4a
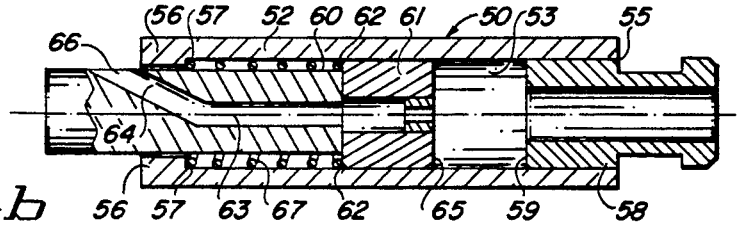
FIG. 4b

TOILET SEAT BIDET ASSEMBLY

BACKGROUND OF THE INVENTION

1. Field of the Invention

The present invention relates to a toilet seat bidet assembly for use on a toilet bowl, which includes flow actuated, pop out cleansing spouts that are exposed only when water is flowing therethrough, thereby providing a completely sanitary and highly effective means of cleansing a user's intimate parts.

2. Description of the Related Art

Bidets are a commonly used cleansing medium in many bathrooms. Generally, however, bidets are separate structures positioned alongside a standard toilet bowl, thereby requiring much more room in a bathroom if both are desired. For this reason, there have been many attempts in the past to devise a bidet system which can be formed integrally with the toilet bowl, thereby requiring only a single structure. Bidet apparatuses such as those in Aoyama, U.S. Pat. No. 4,967,423, Kou, U.S. Pat. No. 4,850,060, and Baus, U.S. Pat. No. 4,321,715, all include nozzles formed with or attached to the toilet seat for use as a bidet. These assemblies, however, have permanently exposed spray nozzles which remain positioned in the central opening of the toilet seat whether in use or not in use. As a result, the spray nozzles detract from the appearance of the toilet and can become easily contaminated during normal use of the toilet bowl, thereby lessening the sanitary conditions of using the bidet. Other assemblies, such as those recited by Basile, U.S. Pat. No. 4,924,534, and Yui, U.S. Pat. No. 4,553,274 and U.S. Pat. No. 4,550,454 attempt to utilize retractable spray systems to maximize the sanitary use of their bidet assemblies. Unfortunately, the spray nozzles must be manually positioned, a procedure which can often be difficult to perform, requires direct manual contact with the toilet by the user, and is not a highly sanitary procedure. For these reasons, it would be highly beneficial to have a bidet assembly which while conveniently being included as part of the toilet seat, also maximizes the sanitary conditions of use by retracting the water spouts when they are not in use and automatically positioning the water spouts when the device is used. The device of the present invention is devised to do precisely that.

The device of the present invention overcomes the drawbacks of the prior art by providing a system which is integrally formed with the toilet seat and keeps the water spouts concealed within the toilet seat when the bidet system is not in use and the toilet is being used regularly. Further, when use of the bidet system is desired, the water spouts automatically pop out into position and as a result of the constant flow of water therethrough while the spouts are exposed, will not become contaminated during cleansing, a further benefit of the present invention.

SUMMARY OF THE INVENTION

The present invention is directed towards a toilet seat bidet assembly for use on a toilet bowl. The bidet assembly includes primarily a toilet seat which is pivotally mounted atop the toilet bowl. The toilet seat is made up of an upper molded seat portion, a flat base portion structured and disposed for support and positioning atop a rim portion of the toilet bowl, and a central opening. The upper portion and the base portion of the toilet seat are attached to one another so as to form a standard looking toilet seat and form a hollow channel therebetween. Disposed within the hollow channel of the toilet seat are a pair of flow actuated, pop out cleansing spouts. The cleansing spouts are mounted in spaced apart relation from one another so as to maximize the cleansing area, and are positioned so as to extend through the upper portion of the toilet seat into the central opening of the toilet seat when water is flowing therethrough. When water is no longer flowing through the cleansing spouts retract and remain within the hollow channel where they are out of the way of potential contamination. As a result, only when water is flowing through the cleansing spouts, and accordingly, flushing it and keeping it clean from any potential contamination, will the spouts be exposed. In order to deliver water to the cleansing spouts, conduit means are included which connect the cleansing spouts with water inlet means, the water inlet means being connected in fluid flow communication to a water source for receipt of water therethrough.

It is an object of the present invention to provide a bidet assembly which can be integrally formed with a toilet bowl assembly, thereby requiring only a single structure in the bathroom to perform multiple functions.

Yet another object of the present invention is to provide a toilet seat bidet assembly which includes effective cleansing spouts which are exposed from a concealed position within the toilet seat only when water is flowing therethrough, thereby assuring that the spouts never become contaminated and, accordingly, maximizing the sanitary conditions of the bidet assembly's use.

Still another object of the present invention is to provide a bidet assembly which can be added to existing toilet bowl assemblies.

A further object of the present invention is to provide a toilet seat bidet assembly which is easy to operate and does not require complicated adjustment or maneuvering to activate the assembly and begin cleansing.

An additional object of the present invention is to provide a toilet seat bidet assembly which will not detract from the appearance of an existing toilet bowl assembly.

BRIEF DESCRIPTION OF THE DRAWINGS

For a detailed understanding of the nature of the present invention, reference should be had to the following detailed description taken in connection with the accompanying drawings in which:

FIG. 3 is a top view of the toilet seat bidet assembly.

FIG. 4A is a cross-sectional view of the cleansing spout in a retracted position.

FIG. 4B is a cross-sectional view of the cleansing spout in an extended position.

FIG. 5 is a bottom perspective view of the mounting unit of the toilet seat bidet assembly.

Like reference numerals refer to like parts throughout the several views of the drawings.

DETAILED DESCRIPTION OF THE PREFERRED EMBODIMENT

Shown throughout FIGS. 1-6, the present invention is directed towards a toilet seat bidet assembly, generally indicated as 10. The bidet assembly 10 is adapted to be pivotally mounted to a standard toilet bowl 100 and include a standard lid 110 thereover.

Figure 1:
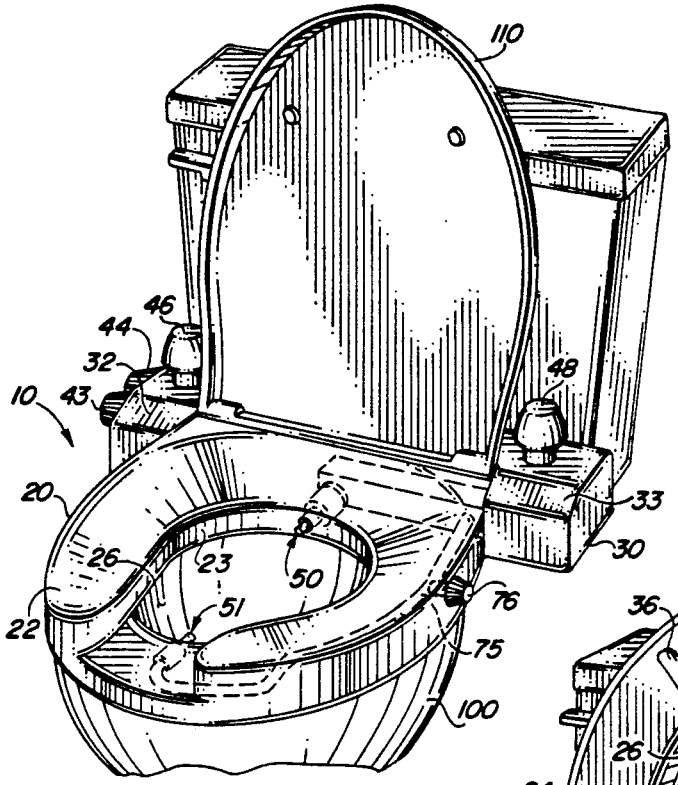
FIG. 1 is a perspective view of the toilet seat bidet assembly mounted to a toilet bowl and in a lowered, seating position.
Figure 6:
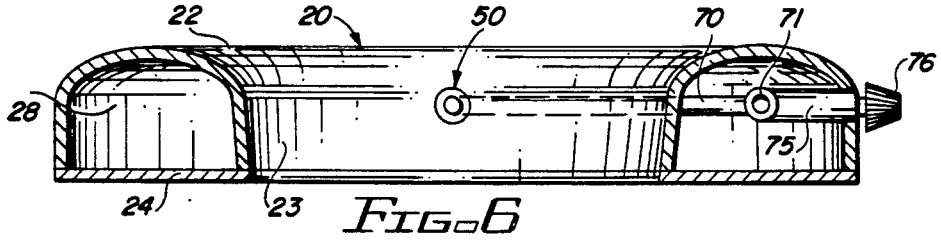
FIG. 6 is a cross-sectional view along line 6—6 of FIG. 3.

The toilet seat bidet assembly 10 primarily includes a toilet seat 20 and a mounting unit 30 to which the toilet seat 20 is mounted. This mounting unit 30, as best seen in FIG. 3, includes an elongate central portion 31 and protruding distal end portions 32 and 33 so as to be generally C-shaped. The toilet seat 20 is adapted to be positioned between the distal end portions 32 and 33 of the mounting unit 30, and is hingedly positioned on hinge pins 34 and 35 so as to be movable between a lowered, seating position resting upon the rim 105 of the toilet bowl 100, or an elevated out of the way position, as detailed in FIGS. 1 and 2. Much like ordinary toilet seats, the toilet seat 20 includes a number of rubber supports 36 disposed to contact the rim 105 of the toilet bowl 100 so as to support the toilet seat 20. Referring to FIGS. 1 and 6, the toilet seat 20 includes an upper, molded seat portion 22, a base portion 24, and an open central portion 26. The open central portion 26 is surrounded by the inner rim portion 23 of the upper portion 22 of the toilet seat 20. Further, the upper portion 22 and base portion 24 are attached to one another so as to form a hollow channel 28 therebetween.

Turning to FIGS. 3 and 5, disposed within a distal end portion 32 of the mounting unit 30 is a mixer valve 40. This mixer valve 40 includes a hot water inlet 41 and a cold water inlet 42 adapted to be correspondingly connected to a hot water source 115 and a cold water source 120. Disposed exteriorly of the mounting unit 30 and connected to the mixer valve 40 are a hot water flow adjustment control 43 and a cold water flow adjustment control 44 which enables a user to regulate the temperature of water being used in the toilet seat bidet assembly 10. The mixer valve 40 includes a single outlet 45 through which the mixed hot and cold water may exit, the rate of flow out the outlet 45 being regulated by an exteriorly positioned outlet flow adjustment control 46 which is connected to the mixer valve 40. Water exiting through the outlet 45 passes through a primary conduit 47 and through a vacuum breaker 48 which is disposed to prevent any unexpected suction from backing up into the hot or cold water sources 115 or 120. Finally, a short connector conduit 49 directs the flow of water which exits the vacuum breaker 48 to a specially adapted hinge pin 35. The hinge pin 35 is hollow so as to allow the passage of water therethrough, and accordingly enables the water flow to exit the mounting unit 30, by means of the connector conduit 49 and enter the hollow channel 28.

Figure 2:
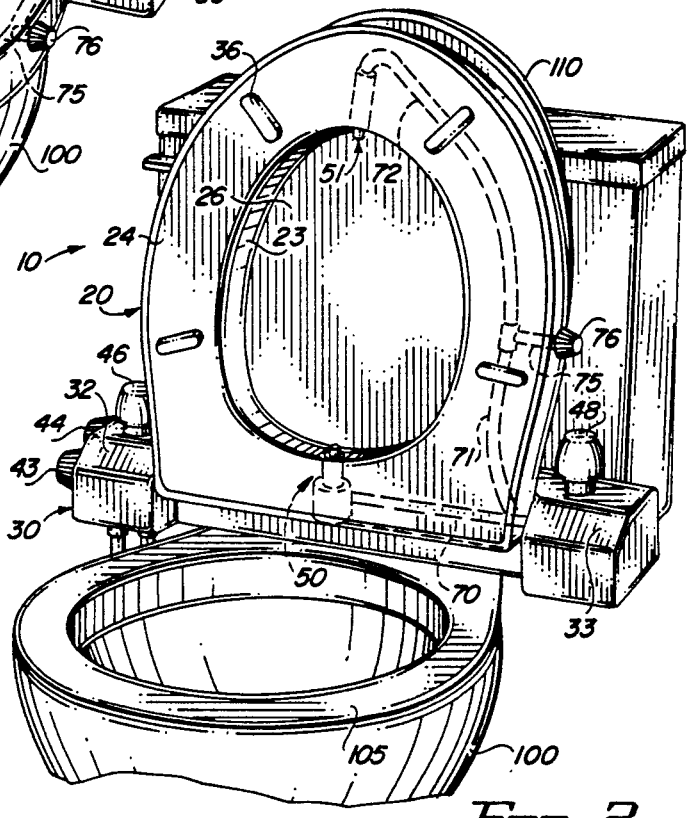
FIG. 2 is a perspective view of the toilet seat bidet assembly mounted to a toilet bowl and in a raised, out of the way position.

As best shown in FIGS. 2 and 3, water exiting the hinge pin 35 enters a secondary conduit 70 which has a offtake conduit 71 in fluid communication therewith. The secondary conduit 70 directs the flow of water to a first pop out cleansing spout 50 at the rear of the toilet seat 20. Water passing through the takeoff conduit 71 passes to a flow control valve 75 which is exteriorly controlled by a knob 76, so as to further regulate the passage of water as desired by the user. Upon exiting the flow control valve 75, water passes through a conduit 72 which is connected to the second pop out cleansing spout 51 located at a front portion of the toilet seat 20.

Detailed in FIGS. 1, 2, 3 and 6, the cleansing spouts 50 and 51 are disposed in spaced apart relation from one another and are adapted to extend through the inner rim 23 in the upper portion 22 of the toilet seat 20 when in use. Generally, when not in use, the cleansing spouts 50 and 51 are completely retracted within the hollow channel 28 of the toilet seat 20, and when in use, protrude into the central open portion 26 of the toilet seat 20 so as to properly cleanse the intimate parts of a user.

Turning to FIGS. 4A and 4B, each of the cleansing spouts 50 or 51 includes a cylinder 52 having a hollow central bore 53 extending axially therethrough, and having an open distal end 54 and an open proximal end 55. At the open distal end 54 of the cylinder 52 is a reduced diameter portion 56 which forms a shoulder 57 within the bore 53 of the cylinder 52. Extending from the open proximal end 55 of the cylinder 52 is a connector segment 58. The connector segment 58 is adapted to connect in fluid communication with one of the flow conduits 70 or 72. Additionally, the connector segment 58 forms a shoulder 59 within the hollow bore 53 of the cylinder 52. Positioned within the hollow bore 53 of the cylinder 52 is a sliding water outlet member 60. The outlet member 60 includes a larger diameter hub portion 61 at a proximal end 65 thereof, the hub 61 being adapted to abut the shoulder 59 formed by the connector segment 58 when the outlet member 60 is completely retracted, as shown in FIG. 4A, or to abut the shoulder 57 formed by the reduced diameter portion 56 when the outlet member 60 protrudes through the open distal end 54 of the cylinder 52 and accordingly out into the open central portion 26 of the toilet seat 20. Positioned about the outlet member 60 and abutting a shoulder 62 formed by the hub portion 61 and a shoulder 57 formed by the reduced diameter portion 56, is a spring 67. The spring 67, when fully extended, maintains the outlet member 60 completely contained within the cylinder 52, unless a compressive force is exerted thereon. Accordingly, when water passes into the cylinder 52 through the connector segment 58 and contacts the proximal end 65 of the outlet member 60, the spring 67 is compressed and the outlet member 60 protrudes from the cylinder 52. Extending through the outlet member 60 is a flow channel 63 which is adapted to allow the passage of water therethrough for cleansing of a user. In order to assure proper directing of the water exiting the outlet member 60, the flow channel 63 includes an upwardly angled distal end 64 which directs water out the spout opening 66 in an angle appropriate for cleansing. As is evident from the illustrations of FIGS. 4A and 4B, the outlet member 60 will remain substantially free from contamination as it and its spout opening 66 are completely contained with the cylinder 52 when not in use, and when in use, water is constantly flowing through the spout opening 66 so as to assure that any contaminants are immediately washed away.

Finally, referring to FIG. 5, the mounting unit 30 is adapted to be secured atop the toilet bowl 100 by means of a pair of mounting brackets 80 having bolts 81 extending therethrough to secure the toilet seat bidet assembly 10 to the toilet bowl 100.

Now that the invention has been described,

What is claimed is:

1. For use on a toilet bowl, a toilet seat bidet assembly comprising:

a toilet seat adapted to be pivotally mounted atop a toilet bowl, said toilet seat including an upper molded seat portion, a flat base portion structured and disposed for supported positioning atop a rim portion of a toilet bowl and a central opening, said upper portion and said base portion of said toilet seat being attached to one another so as to form a hollow channel therebetween, a pair of flow actuated, pop out cleansing spouts mounted within said hollow chamber in spaced apart relation from one another, said spouts being structured and disposed to move outwardly to an extended position through said upper portion of said toilet seat and into said central opening thereof in response to pressure from water flowing therethrough, so as to cleanse a user's intimate parts, said spouts being further structured to move to a normally retracted position within said hollow channel when the water flow is stopped so as to remove concealed and protected from potential contamination, water inlet means structured and disposed to be connected in fluid flow communication to a water source for receipt of water therethrough, conduit means structured and disposed to direct water from said water inlet means, through said hollow channel, in said toilet seat to said spouts, and a mounting unit attached to a toilet bowl, said toilet seat pivotally mounted to said mounting unit so as to be movable between a raised, out of the way position, and a lowered, seating position atop a rim portion of a toilet bowl.

2. A toilet seat bidet assembly as in claim 1 wherein said water inlet means includes a mixer valve mounted within said mounting unit, said mixer valve including a hot water inlet and a cold water inlet structured and disposed to be correspondingly connected to a hot water source and a cold water source.

3. A toilet seat bidet assembly as in claim 2 wherein said mixer valve further includes a water outlet structured and disposed to direct the mixed hot and cold water out of said mixer valve, and flow adjustment means structured and disposed to regulate the quantity of hot and cold water entering said mixer valve and the force of the water exiting said valve.

4. A toilet seat bidet assembly as in claim 3 wherein said conduit means includes primary conduit means structured and disposed to direct the flow of water through said mounting unit and into said hollow channel in said toilet seat, and secondary conduit means connected in fluid flow communication with said primary conduit means and extending through said hollow channel of said toilet seat so as to direct water to said spouts.

5. For use on a toilet bowl, a toilet seat bidet assembly, comprising:

a mounting unit, said mounting unit being adapted to be attached to the toilet bowl, a toilet seat, said toilet seat being pivotally mounted to said mounting unit so as to be movable between a raised, out of the way position, and a lowered, sitting position atop a rim portion of the toilet bowl, said toilet seat including an upper contoured seat portion, a flat base portion, structured and disposed for supported positioning on the rim portion of the toilet bowl, and a central opening, said upper portion and said base portion being attachable to one another so as to form a hollow channel therebetween, said mounting unit including a mixer valve mounted therein, said mixer valve including a hot water inlet and a cold water inlet structured and disposed to be correspondingly connected to a hot water source and a cold water source, said mixer valve further including a water outlet structured and disposed to direct mixed hot and cold water out of said mixer valve, and flow adjustment controls structured and disposed to regulate the quantity of hot and cold water entering the mixer valve and the force of water exiting said valve, primary conduit means structured and disposed to direct the flow of water through said mounting unit and into said hollow channel in said toilet seat, a pair of flow actuated, pop out cleansing spouts mounted within said hollow chamber in spaced apart relation from one another, said spouts being structured and disposed to extend through said upper portion of said toilet seat into said central opening in said toilet seat when water is flowing therethrough, so as to cleanse a user's intimate parts and to retract and to remain within said hollow channel when the water flow is stopped so as to remain out of the way of potential contamination, and secondary conduit means connected in fluid flow communication with said primary conduit means, said secondary conduit means extending through said hollow channel of said toilet seat and being structured and disposed to direct water flow to said pair of cleansing spouts.

6. A toilet seat bidet assembly as in claim 5 wherein each of said spouts includes a hollow cylinder having an open distal end, an open proximal end, and a hollow central bore extending axially therethrough said bore being of a reduced diameter at said open distal end of said cylinder so as to form a shoulder.

7. A toilet seat bidet assembly as in claim 6 wherein each of said spouts includes a connector segment positioned within said bore in said cylinder near said open proximal end of said cylinder, said connector segment being sufficiently elongate so as to extend from said open proximal end of said cylinder and be connected in fluid flow communication with said secondary conduit means.

8. A toilet seat bidet assembly as in claim 7 wherein each of said spouts also includes a sliding water outlet member slidably positioned within said bore of said cylinder between said reduced diameter portion of said bore and said connector member, said water outlet member including an increased diameter hub portion structured and disposed to abut a shoulder formed between said cylinder and said connector member when said outlet member is in a retracted position completely within said cylinder, and said shoulder portion formed by said reduced diameter portion of said bore when said outlet member is in a completely extended position so as to substantially protrude from said cylinder and out from said hollow channel in said toilet seat.

9. A toilet seat bidet assembly as in claim 8 wherein said outlet member includes a flow channel extending therethrough, said flow channel including an upwardly angled distal end structured and disposed to direct the flow of water upward to cleanse the intimate parts of the user.

10. A toilet seat bidet assembly as in claim 9 wherein each of said spouts further includes a spring positioned in said bore in said cylinder about said water outlet member such that opposite ends of said spring abut said shoulder formed by said reduced diameter portion of said bore and a shoulder formed by said hub portion of said outlet member, thereby maintaining said outlet member in said retracted position when no water is passing into said spout and in said extended position when water is passing into said spout contacting said hub portion and passing through said flow channel in said outlet member.

11. A toilet seat bidet assembly as in claim 10 further including a vacuum breaker connecting said primary conduit and said secondary conduit means.

12. A toilet seat bidet assembly as in claim 11 further including a flow control valve connected to said secondary conduit means and protruding from said upper portion of said toilet seat so as to enable the user to easily regulate the flow of water.

* * * * *